United States Patent [19]

Guttmann

[11] 4,179,249

[45] Dec. 18, 1979

[54] QUICK LOADING PERISTALTIC PUMP

[75] Inventor: Emil J. Guttmann, Morton Grove, Ill.

[73] Assignee: Cole-Parmer Instrument Company, Chicago, Ill.

[21] Appl. No.: 858,270

[22] Filed: Dec. 7, 1977

[51] Int. Cl.[2] ..... F04B 43/12; F04B 45/08

[52] U.S. Cl. ..... 417/477

[58] Field of Search ..... 417/477, 476, 475

[56] References Cited

U.S. PATENT DOCUMENTS

| | | | |
|---|---|---|---|
| 3,425,357 | 2/1969 | Bilichniansky et al. | 417/475 |
| 3,723,030 | 3/1973 | Gelfand | 417/477 X |
| 3,841,799 | 10/1974 | Spinosa et al. | 417/477 |
| 4,138,205 | 2/1979 | Wallach | 417/477 |

*Primary Examiner*—William L. Freeh
*Assistant Examiner*—R. E. Gluck
*Attorney, Agent, or Firm*—Fitch, Even & Tabin

[57] ABSTRACT

A peristaltic pump is disclosed which facilitates quick loading of a compressible tubular conduit through which fluid may be pumped. The pump includes a pair of reaction members pivotally mounted on a base plate for movement between open and closed positions relative to a rotor, the reaction members being releasably retained in their closed positions by a locking plate. The compressible tube partially encircles the rotor and has its ends releasably engaged by clamping means which prevents axial movement of the tube and is adapted to accommodate tubes of different diameter.

18 Claims, 8 Drawing Figures

3.
3.
88
88a
90
22
80
93a
86b
86
93b
16
93c
12a
10
84a
102a
84b
100b
4.
82
4.
100a
94
60
50a
50b
102b
20a
106a
86a
88b
12
44
14
48a
48b
106d
18a
28
58
26
18b
32
20b
75
75
106b
66
106c
48c
64c
18
52
5.
5.
26b
20
74
26a
54a
18c
20c
54b
62
72
70
64

80
94a
92
22
90
86b
12a
10
82a
84
94
96
60
82
84b
50a
16
14
46
34a
26
44
38
32
42
48b
34b
40
48c
30a
30
36
18b
12
18c
54a
28
52

32
78
12a
90
12
77
92
76
93a
75
75
80
28
16
84b
84a
20a
18a
98a
74
94
22
88a
60
88b
98b
64

12
66a
28
66
64a
68
64

82
96
12
80a
28
80
102a
102b
84b
84a
18a
20a
98a
94
16
100a
22
100b
98b

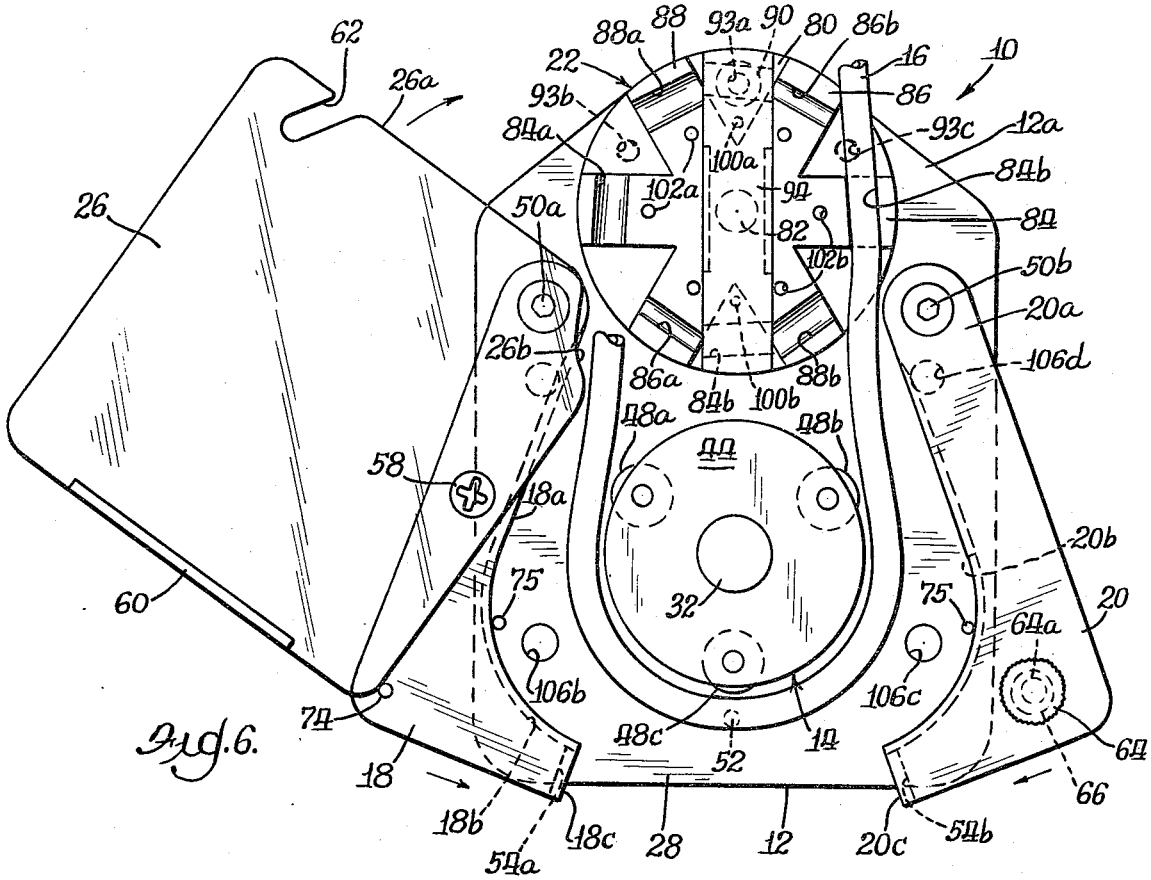
Fig. 6.
Fig. 7.
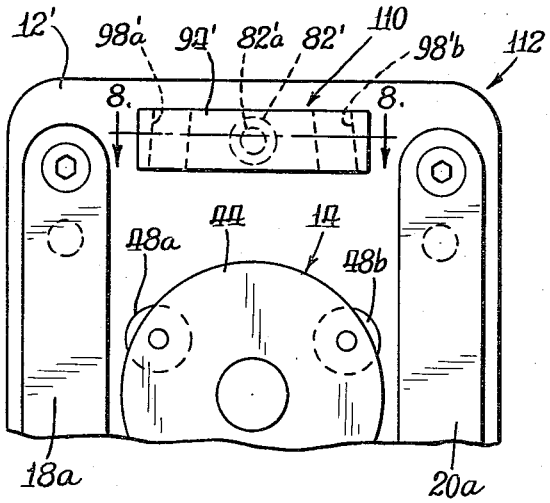
Fig. 8.
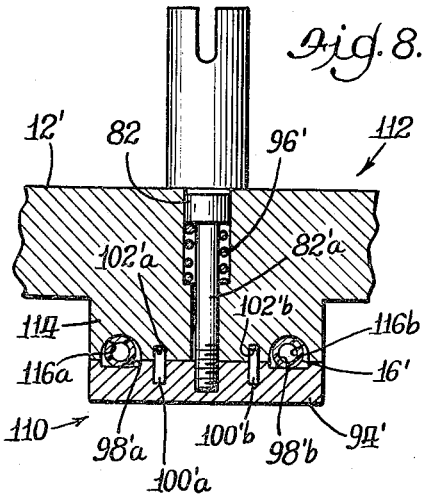

QUICK LOADING PERISTALTIC PUMP

The present invention relates generally to fluid pumps, and more particularly to a novel peristaltic pump which facilitates quick loading, servicing and replacement of a compressible tubular conduit in operative association with a rotor, and which is adapted to accommodate compressible tubes of different diameter.

Fluid pumps of the peristaltic type operative to effect a moving region or regions of compression along a compressible tubular conduit are generally known. Movement of a compressed region of the tubular conduit axially along the tube forces fluid ahead of the moving region, and the action of the tube in returning to its uncompressed condition creates a partial vacuum which effects forward flow of fluid from the area rearwardly of the compressed tube region. See, for example, U.S. Pat. No. 3,358,609, dated Dec. 19, 1967, and assigned to the assignee of the present invention.

While peristaltic pumps are highly superior in many applications, they are characterized by the requirement that the compressible tube be periodically replaced due to failure by fatigue and abrasion. Replacement of compressible tubes in peristaltic pumps heretofore available is often difficult and time consuming and therefore leaves much to be desired. The time required to replace or adjust the compressible tube affects the "downtime" of the system in which the pump is used and therefore has a significant bearing on the operating costs of the system. The ease and quickness in which the compressible tube may be loaded into the peristaltic pump and subsequently serviced or replaced is thus an important characteristic of the pump.

Accordingly, a general object of the present invention is to provide a novel peristaltic pump which facilitates quick loading, servicing and unloading of a compressible tube relative to a rotor adapted to effect a peristaltic pumping action on the tube.

A more particular object of the present invention is to provide a novel peristaltic pump having a pair of reaction members pivotally mounted on a base plate for movement between closed positions effecting engagement of the compressible tube with the rotor to cause a peristaltic pumping action on the tube, and open positions spaced outwardly from the rotor to facilitate loading or servicing of the tube. The pump includes novel means for releasably retaining the reaction members in their closed positions while allowing quick opening for access to the tube and rotor.

A further object of the present invention is to provide a peristaltic pump having novel clamping means for releasably retaining the compressible tube in fixed position relative to the rotor.

A still further object of the present invention is to provide a peristaltic pump wherein the clamping means for retaining the compressible tube in fixed relation to the rotor is adapted to accommodate tubes of different diameters.

A feature of the peristaltic pump in accordance with the present invention lies in the provision of a novel shield and locking plate carried by one of the reaction members and having a cam groove therein cooperable with an adjustable locking pin carried by the other of the reaction members to insure full closing of the reaction members.

Further objects, features and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 6 is a front elevational view of the pump of FIG. 1 but showing the reaction members in their open positions to facilitate loading, servicing or replacement of the compressible tube;

FIG. 7 is a fragmentary front elevational view of a peristaltic pump in accordance with the present invention which incorporates an alternative tube clamping arrangement; and FIG. 8 is a fragmentary sectional view taken substantially along line 8—8 of FIG. 7, looking in the direction of the arrows.

Figure 1:
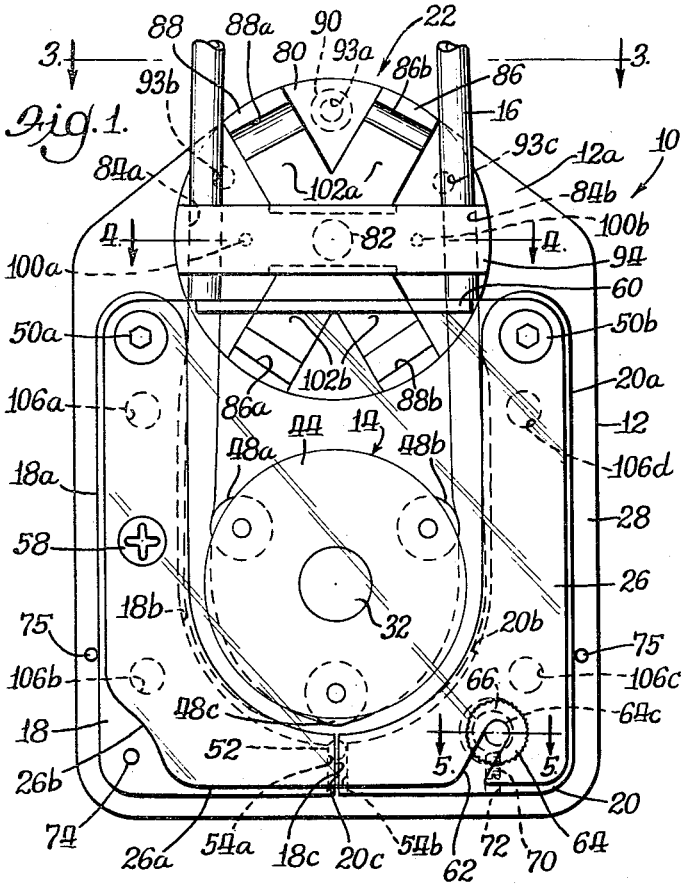
FIG. 1 is a front elevational view of a peristaltic pump constructed in accordance with one embodiment of the present invention.

Referring now to the drawings, and in particular to FIGS. 1-4, a peristaltic pump constructed in accordance with one embodiment of the present invention is indicated generally at 10. Very generally, the peristaltic pump 10 includes a base plate 12, alternatively termed a back plate, which rotatably supports a rotor 14 having cooperative relation with a compressible tubular conduit or tube 16 normally maintained in operating position so as to partially encircle the rotor by a pair of reaction members 18 and 20 pivotally mounted on the base plate 12. The tube 16, which may comprise a portion of a relatively long length of tube or may comprise a relatively short length tube having fittings on its opposite ends for connection in a fluid handling tube system, is maintained in fixed axial position relative to the base plate 12 and the rotor 14 by clamping mechanism means, indicated generally at 22, also mounted on the base plate 12.

The reaction members 18 and 20, which may be termed reaction arms, are preferably symmetrical about a median plane normal to the base plate 12 and containing the axes of the rotor 14 and clamping mechanism means 22, as will become more apparent hereinbelow. The reaction members 16 and 18 are movable between first closed positions operative to effect engagement of the tube 16 with the rotor 14 so as to effect a peristaltic pumping action on the tube during rotation of the rotor, and second open positions, as best seen in FIG. 6, spaced outwardly from the rotor to facilitate access to the tube and rotor for loading, replacement or servicing of the tube or rotor. The reaction members 18 and 20 are releasably maintained in their closed positions by a shield cover and locking plate 26 which serves both to maintain the reaction members in their closed positions and provide a protective shield for the rotor 14 and associated tube 16 during operation of the peristaltic pump 10.

In the closed positions of the reaction members 18 and 20 as shown in FIG. 1, rotation of the rotor 14 is operative to effect a peristaltic pumping action on the tube 16 in a manner to establish a sequential series of moving regions of compression along the tube and cause axial flow of fluid therethrough, as is known.

Turning now to a more detailed description of the peristaltic pump 10, the base plate 12 is generally rectangular except for a generally triangularly shaped upper end portion 12*a*. The base plate 12 has an outer planar mounting surface 28 and is formed with a cylindrical bore 30 through which a drive shaft 32 extends. The drive shaft 32 is rotatably supported by a pair of radial anti-friction bearings 34*a* and 34*b* spaced axially on the drive shaft by an annular spacer sleeve 36 and fixed on the drive shaft by suitable retaining rings one of which is shown at 38. The bearings 34*a, b* are retained within the bore 30 such as by an annular lip 30*a* formed within the bore and a retainer ring 40 received within a suitably sized groove in the bore 30. Alternative: cement or press fit bearing in place.

The drive shaft 32 extends rearwardly of the base plate 12 and has a transverse slot 42 formed in its outer end to facilitate connection of the drive shaft to a suitable drive motor (not shown) for effecting rotation of the rotor 14. The drive shaft 32 also extends forwardly from the mounting surface 28 on the base plate and has a pair of parallel axially spaced annular discs 44 and 46 fixedly mounted thereon for rotation therewith. The discs 44 and 46 support a plurality of rotatable rollers therebetween, there being three rollers 48*a, b* and *c* employed in the illustrated embodiment. As best seen in FIG. 1, the rollers 48*a, b* and *c* are mounted between the support discs 44 and 46 such that their outer cylindrical surfaces define compression surfaces for rolling engagement with the tube 16 during operation of the pump.

The reaction members 18 and 20 have arm portions 18*a* and 20*a*, respectively, which are laterally spaced from the longitudinal axis of the base plate 12 and define a throat area therebetween, as will be described more fully hereinbelow. The reaction members are pivotally mounted on the base plate 12 through support screws 50*a* and 50*b*, respectively, received through suitable bores in the arm portions 18*a* and 20*a* and having threaded engagement with the base plate. The reaction members 18 and 20 define oppositely facing cam surfaces 18*b* and 20*b*, respectively, which, when the reaction members are closed as in FIG. 1, form a continuous uniform surface adapted to retain the tube 16 in position to be totally collapsed by successive ones of rollers 48*a–c* as the rotor 14 is rotated. The cam surfaces 18*b* and 20*b* are arcuate in transverse profile so as to retain the tube 16 centrally of the cylindrical rollers 48*a–c*, as is known. Stop surfaces 18*c* and 20*c* are formed on the reaction members 18 and 20 for abutting relation when the reaction members are in closed positions. A stop pin 52 is mounted on the base plate 12 to extend outwardly from the mounting surface 28 and is positioned to be received within complementary recesses 54*a* and 54*b* formed in the reaction members 18 and 20, respectively, when the reaction members are in their closed positions. The stop pin 52 serves to locate the reaction members in symmetrical relation to the rotor 14 when in closed position, and prevents "over-center" movement of either of the reaction members relative to the rotor.

Figure 2:
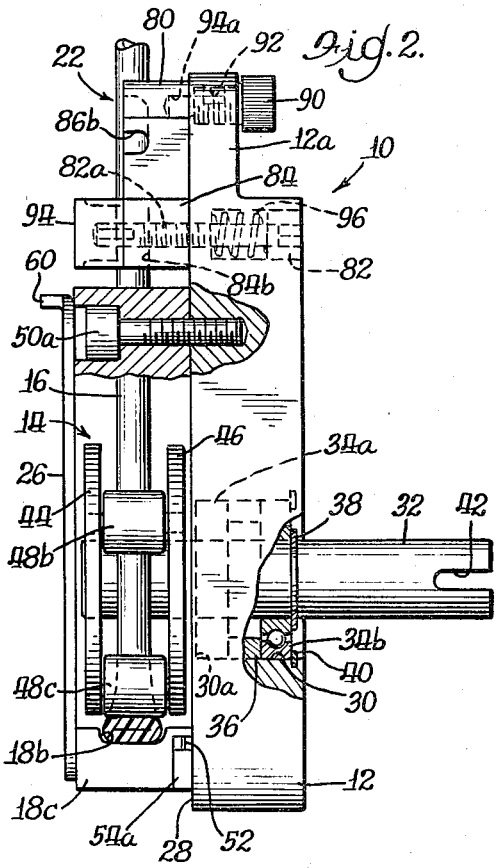
FIG. 2 is a side elevational view of the peristaltic pump of FIG. 1 but with portions broken away for clarity.

The reaction members 18 and 20 are releasably maintained in their closed positions by the generally rectangular locking plate and shield cover 26. The locking plate 26 is preferably made of a transparent plastic to facilitate viewing of the rotor and associated compressible tube 16 without opening the reaction members. The locking plate 26 is pivotally mounted on one of the reaction members, such as 18, through a pivot pin 58 and has an outwardly directed flange 60 formed at its upper edge, as best seen in FIGS. 1 and 2, to facilitate grasping of the cover plate for manipulation.

The locking plate 26 has a locking slot 62 formed therein to intersect the bottom edge 26*a*. The slot 62 is angularly inclined relative to the bottom edge 26*a* of the locking plate and is adapted to receive the shank 64*a* of a locking screw 64 mounted on the reaction member 20 when the reaction members are in closed positions. The locking screw 64 has threaded connection with an adjustable cylindrical mounting block 66 frictionally received within a bore 68 in the reaction member 20. The screw shank 64*a* is eccentric to the center axis of the cylindrical mounting block 66 so that rotation of the mounting block relative to the reaction member 20 through a cross slot 66*a* in the inner end of the mounting block adjusts the locking relation of the cam slot 62 and locking screw 64. The mounting block 66 is fixed in selected position within the bore 68 by a suitable set screw 70 accessible through a bore 72 in the reaction member 20. The mounting block 66 may be adjusted to obtain desired closing of the reaction members and compensate for manufacturing tolerances. The inclined cam slot 62 is configured to cam the reaction members against the compressible tube 16 during closing of the reaction members.

A stop pin 74 is mounted on the reaction member 18 adjacent its lower corner edge to limit rotation of the cover plate in an open position, as seen in FIG. 6, and maintain the locking plate in an out-of-the-way position when the reaction members are in their open positions facilitating access to the tube 16 and associated rotor 14. The cover plate 26 is recessed as necessary as at 26*b* to permit full movement of the cover plate between its locking position with the locking screw 64 and its open position.

Figure 3:
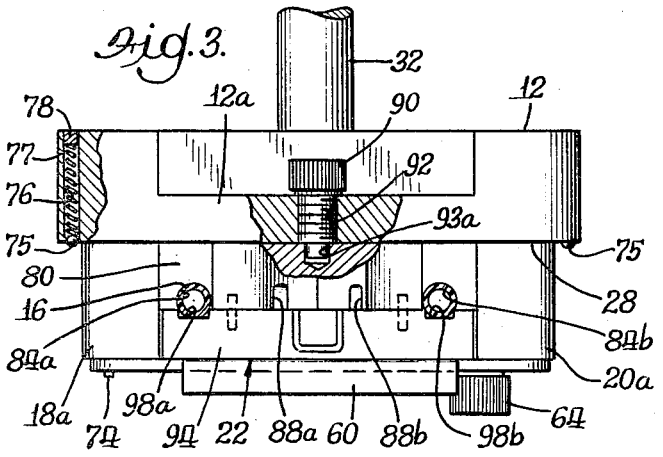
FIG. 3 is a top plan view taken substantially along the line 3—3 of FIG. 1, with portions broken away for clarity.
Figure 5:
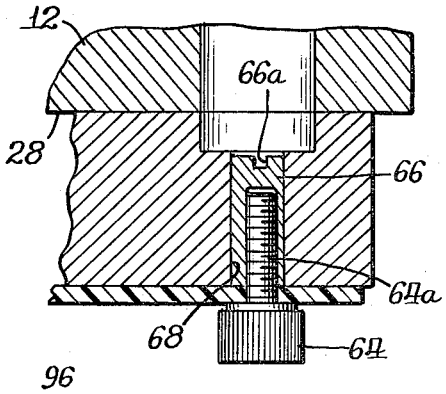
FIG. 5 is a fragmentary sectional view taken substantially along the line 5—5 of FIG. 1, looking in the direction of the arrows.

To maintain the reaction members 18 and 20 in their open positions while loading or servicing the tube 16, a spring loaded detent 75 is mounted on each lateral side of the base plate 12, as best seen in FIGS. 3 and 6. Each detent 75 comprises a ball which is biased outwardly of a suitable bore 76 in the base plate by a compression spring 77 acting between its associated ball detent 75 and a plug 78 fixed within the rear end of each bore 76. The spring force of springs 77 is relatively light so that the reaction members may be closed without undue force.

With the compressible tube 16 partially encircling the rotor 14 and being maintained in proper position relative to the rollers 48*a–c* by the closed reaction members 18 and 20, the free ends of the tube, which serve as the inlet and outlet for fluid passing through the tube, are received upwardly through the throat area defined between the upstanding arm portions 18*a* and 20*a* of the closed reaction members. The clamping mechanism means 22 is operative to releasably engage the ends of the tube 16 and prevent axial movement of the tube during rotation of the rotor 14. In the embodiment of the clamping mechanism means 22 illustrated in FIGS. 1–6, the clamping mechanism includes an inner circular clamping disc 80 which is rotatable about the shank 82*a* of a mounting screw 82 received through a central bore 80*a* in the clamping disc. The clamping disc defines a plurality of pairs of tube receiving grooves 84*a, b,* 86*a, b,* and 88*a, b,* each pair of grooves being formed in a corresponding cross arm 84, 86 and 88 extending outwardly from the circular base portion of the disc 80 and lying on a diameter of the disc. Each of the grooves 84*a, b,* 86*a, b* and 88*a, b* is generally semi-circular in transverse cross section, as best seen in FIG. 3, and each pair of grooves has a different radius so that each pair of grooves is adapted for clamping engagement and retention of a compressible tube of different diameter.

A locking screw 90 has threaded engagement with a threaded bore 92 in the upstanding end 12*a* of the base plate 12 and is adapted to have its inner end received in locking position within a selected one of three suitable recesses 93*a, b* and *c* formed on a common circular center line within the rear surface of the clamping disc 80. The recesses 93*a, b* and *c* and positioned so as to be registrable with the locking screw 90 when the clamping disc 80 is disposed in a position wherein a selected one of the arms 84, 86 and 88 is transverse to a plane containing the axes of the rotor 14 and the mounting screw 82. The outer edge of the clamping disc 80 is preferably coded, such as by numbers, at the outer ends of the arms 84, 86 and 88 so that the operator can determine which size tubing to use by observing the code number near the thumb screw 90 when the clamping disc is locked in a selected position.

Figure 4:
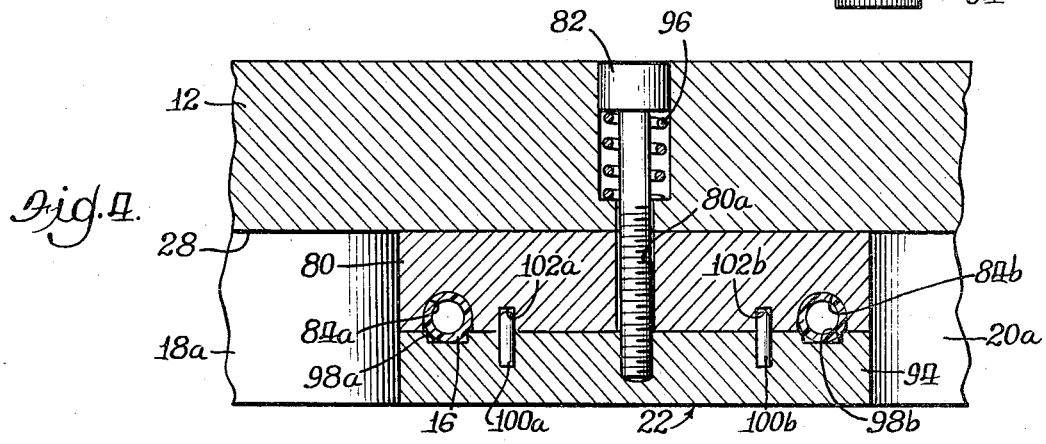
FIG. 4 is a fragmentary sectional view taken substantially along the line 4—4 of FIG. 1, looking in the direction of the arrows.

To retain the tube 16 within the grooves 84*a, b,* 86*a, b* or 88*a, b,* of the corresponding cross arm 84, 86 or 88 disposed transverse to the longitudinal axis of the base plate 12, the clamping mechanism 22 includes an outer clamping bar 94 mounted for cooperation with the transverse one of the arms 84, 86 and 88 to clamp the tube within the corresponding pair of tube receiving grooves. The clamping bar 94 is releasably secured on the threaded end of the mounting screw 82 and is biased against the opposed arm of the clamping disc 80 by a compression spring 96 acting between the base plate 12 and the head of the mounting screw 82, as best seen in FIG. 4. The clamping bar 94 has a pair of tube clamping grooves 98*a,* 98*b* which are preferably substantially shallower than the corresponding grooves 84*a, b,* 86*a, b* and 88*a, b* formed in the arms 84, 86 and 88 so as to provide frictional clamping of the compressible tube 16 within complementary positioned grooves in the clamping disc 80 and clamping bar 94 without impairing fluid flow through the tube. A pair of retaining pins 100*a* and 100*b* are mounted on the clamping bar 94 and are adapted to be received within suitably positioned recesses 102*a* and 102*b* formed in each of the arms 84, 86 and 88 so as to maintain the clamping bar in proper position relative to the underlying arm of the clamping disc 80. In this manner, the clamping bar 94 may be grasped and moved outwardly relative to the clamping disc 80 and rotated to a position disposed 90° to the underlying clamping arm, such as 84 in FIG. 6, to facilitate loading, replacement or adjustment of the tube 16, whereafter the clamping bar 94 may be again returned to a position for cooperating relation with the underlying clamping disc arm and released to fixedly clamp the tube between the complementary pairs of grooves, 84*a,* 98*a* and 84*b,* 98*b*. The locking pins 100*a, b* serve to prevent unintentional rotation of the clamping bar 94 relative to the underlying clamping disc. The clamping disc 80 is formed with V-shaped recessed areas between the arms 84, 86 and 88 to accommodate the retaining pins 100*a, b* when the clamping bar 94 is disposed in a nonclamping position.

As seen in FIG. 1, the axes of the grooves of each of the respective pairs of tube receiving grooves 84*a, b,* 86*a, b* and 88*a, b* are inclined relative to the transverse center line of their respective arm 84, 86 or 88 so that the portions of a tube extending between the clamping mechanism 22 and the rotor 14 are substantially tangent to the rotor 14.

In the embodiment of the clamping mechanism means 22 illustrated in FIGS. 1–6, compressible tubing of different diameters may be employed in the peristaltic pump 10 as long as the different diameter tubes have the same wall thickness. The different diameter tubes are accommodated by selective rotation of the clamping disc 80 to position a selected pair of the tube receiving grooves 84*a, b,* 86*a, b* or 88*a, b* in a position for cooperation with the clamping bar 94. By proper selection of the rotor assembly, compressible tubes having different tube wall thicknesses may also be employed. It will be appreciated that removal of the clamping bar 94 permits interchanging of the clamping disc 80 with another clamping disc having different size tube receiving grooves to accommodate different size tubes.

Preferably, the base plate 12 has a plurality of mounting holes 106*a, b, c* and *d* formed therethrough which facilitate mounting of the peristaltic pump 10 on a suitable drive motor, an example of which is indicated by reference numeral 16 in the copending application of Lawrence R. Hogan, Ser. No. 828,482, filed Aug. 29, 1977, entitled Fluid Pump and Quick Release Mounting Arrangement Therefor, and assigned to the assignee of the present invention.

FIGS. 7 and 8 illustrate an alternative embodiment of a clamping mechanism means, indicated generally at 110, shown in conjunction with a peristaltic pump, a portion of which is indicated generally at 112. The peristaltic pump 112 is substantially identical to the above-describe peristaltic pump 10 except that the base plate 12' thereof does not have an upper generally triangular shaped portion formed thereon as indicated at 12*a* on the aforedescribed base plate 12. The clamping mechanism means 10 differs from the aforedescribed clamping mechanism means 22 in that it is selected for use with a single diameter compressible conduit 16'. To this end, the clamping mechanism means 110 has an inner clamping bar 114 fixed to the mounting surface 28' on the base plate 12'. The inner clamping bar 114 has a pair of laterally spaced grooves 116*a* and 116*b* formed therein which have generally semi-cylindrical transverse configurations of equal radius.

An outer clamping bar 94' is mounted on the end of a threaded shank 82'*a* of a mounting screw 82' which extends through a suitable bore in the base plate 12'. The outer clamping bar 94' has a pair of shallow tube clamping grooves 98'*a* and 98'*b* positioned to overlie and complement the tube receiving grooves 116*a, b* in the inner clamping bar 114 and is biased against the inner clamping bar 114 by a compression spring 96' in similar fashion to the aforedescribed clamping bar 94. The outer clamping bar 94' has a pair of locating pins 100'*a* and 100'*b* mounted therein and adapted to be received within suitably located recesses 102'*a* and 102'*b* formed in the inner clamping bar 114 to prevent unintended rotation of the outer clamping bar. Clamping of a compressible tube 16' between the clamping bars 94' and 114 is effected in a similar manner as described above in respect to the clamping mechanism 22.

Thus, it can be seen that in accordance with the present invention a novel peristaltic pump is provided which significantly improves loading of a compressible tube into the pump in a quick and relatively easy manner. The peristaltic pump 10 illustrated in FIGS. 1–6 facilitates use of the same pump with compressible tubes or conduits of different diameter by selective adjustment of the clamping disc 80. The reaction members 18 and 20 provide means for retaining the compressible tube in operating relation to the rotor 14 while being readily releasable through releasing the shield cover and locking plate 26 to facilitate opening of the reaction members for inspection, adjustment or replacement of the compressible tube and associated rotor 14. In this respect, by maintaining the compressible tube clamped within the clamping mechanism means 22 or 110, the reaction members 18 and 20 may be opened to inspect the tube without stopping the rotor drive motor.

By providing a combination shield cover and locking plate, the pump will not operate if the safety shield is not in its proper position maintaining the reaction members 18 and 20 in their closed positions. This is a significant safety advantage. The cooperative adjustable locking screw 64 on the base plate 12, and cam slot 62 in the locking plate 26 are adjustable to compensate for manufacturing tolerance differences between the reaction members while insuring that the reaction members are in proper position when in their closed positions, the adjustment block 66 being adjustable from externally of the base plate 12.

While preferred embodiments of the present invention have been illustrated and described, it will be understood to those skilled in the art that changes and modifications may be made therein without departing from the invention in its broader aspects.

Various features of the invention are defined in the following claims.

What is claimed is:

1. A peristaltic pump comprising a base plate defining a generally planar mounting surface, a rotor rotatably supported by said base plate for rotation about an axis substantially perpendicular to said mounting surface, said rotor including at least one compression surface movable in a plane substantially parallel to said mounting surface, a pair of reaction members pivotally supported by said base plate for movement relative to said base plate between closed positions juxtaposed to said rotor and open positions spaced from said rotor, said reaction members defining cam surface means operative when said reaction members are in their said closed positions to maintain a compressible fluid flow tube in position to be engaged by said compression surface upon rotation of said rotor so as to effect a peristaltic pumping action on said tube, said reaction members facilitating loading and removal of said tube relative to said rotor when in their said open positions and exposing an outer surface of said rotor when in their said closed positions, and locking plate means mounted on one of said reaction members and selectively cooperable with the other of said reaction members to releasably retain said reaction members in their said closed positions, said locking plate means being adapted to cover said exposed outer surface of said rotor when in said retaining relation with said reaction members so as to prevent access to said rotor.

2. A peristaltic pump as defined in claim 1 including clamping mechanism means mounted on said base plate and adapted to releasably clamp a compressible tube in operative relation about said rotor and prevent axial movement of said tube when said reaction members are in either their said open or closed positions.

3. A peristaltic pump as defined in claim 1 wherein said reaction members are pivotally mounted on said base plate for pivotal movement about pivot axes parallel to the axes of rotation of said rotor.

4. A peristaltic pump as defined in claim 3 wherein said reaction members are substantially symmetrical relative to said rotor, and including stop means mounted on said base plate and cooperative with said reaction members to position said cam surface means in symmetrical relation to said rotor when said reaction members are in their said closed positions.

5. A peristaltic pump as defined in claim 2 wherein said reaction members define a throat opening therebetween defining an entrance opening to said rotor and adapted to receive spaced apart portions of a compressible tube having an intermediate portion looped about said rotor, said tube clamping mechanism means being disposed adjacent said throat opening.

6. A peristaltic pump as defined in claim 5 wherein said compression surface on said rotor traverses a circular path, said tube clamping mechanism means being adapted to clamp a compressible tube in looped relation about said rotor with the tube disposed tangentially to said circular path at the locations at which the tube approaches and leaves said rotor.

7. A peristaltic pump comprising a base plate defining a generally planar mounting surface, a rotor rotatably supported by said base plate for rotation about an axis substantially perpendicular to said mounting surface, said rotor including at least one compression surface movable in a plane substantially parallel to said mounting surface, a pair of reaction members pivotally supported by said base plate for movement relative to said base plate between closed positions juxtaposed to said rotor and open positions spaced from said rotor, said reaction members defining cam surface means operative when said reaction members are in their said closed positions to maintain a compressible fluid flow tube in position to be engaged by said compression surface upon rotation of said rotor so as to effect a peristaltic pumping action on said tube, said reaction members when in their said open positions facilitating loading and removal of said tube relative to said rotor, locking plate means mounted on one of said reaction members, and a locking screw mounted on said other of said reaction members, said locking plate means being pivotally mounted on said one of said reaction members and having a locking groove therein releasably cooperable with said locking screw to maintain said reaction members in their said closed positions.

8. A peristaltic pump as defined in claim 7 wherein said locking screw is adjustable relative to said other of said reaction members to insure a predetermined relationship of other reaction members when disposed in their said closed positions.

9. A peristaltic pump as defined in claim 7 wherein said reaction members are configured to partially encircle said rotor when in their said closed positions, said locking plate having sufficient size to overlie said rotor and being made of a transparent material to facilitate inspection of said rotor and associated compressible tube when in locking relation with said locking screw.

10. A peristaltic pump as defined in claim 7 wherein said locking groove is adapted for cooperation with said locking screw to cam said reaction members toward their said closed positions as said locking screw is received within said locking groove.

11. A peristaltic pump as defined in claim 10 including stop limit means mounted on said base plate for cooperation with said reaction members to establish said reaction members in symmetrical relation to said rotor when in their said closed position.

12. A peristaltic pump comprising a base plate defining a generally planar mounting surface, a rotor rotatably supported by said base plate for rotation about an axis substantially perpendicular to said mounting surface, said rotor including at least one compression surface movable in a plane substantially parallel to said mounting surface, a pair of reaction members pivotally supported by said base plate for movement relative to said base plate between closed positions juxtaposed to said rotor and open positions spaced from said rotor, said reaction members defining cam surface means operative when said reaction members are in their said closed positions to maintain a compressible fluid flow tube in position to be engaged by said compression surface upon rotation of said rotor so as to effect a peristaltic pumping action on said tube, said reaction members when in their said open positions facilitating loading and removal of said tube relative to said rotor, locking plate means mounted on one of said reaction members and selectively cooperable with the other of said reaction members to releasably retain said reaction members in their said closed positions, and clamping mechanism means including a first clamping bar mounted on said base plate, and a second clamping bar releasably cooperable with said first clamping bar and defining laterally spaced tube receiving recesses therebetween, said first and second clamping bars being adapted to receive reaches of a compressible tube within said lateral recesses with an intermediate portion of said tube looped about said rotor, said first and second clamping bars being cooperable to maintain said tube in fixed axial position relative to said rotor.

13. A peristaltic pump as defined in claim 12 wherein said first clamping bar comprises a clamping disc rotatable about an axis parallel to the axis of said rotor and defining a plurality of clamping arms thereon each of which is selectively movable to a position cooperable with said second clamping bar for releasably clamping a tube therebetween, said second clamping bar being movable to a position facilitating release of said tube from said clamping mechanism means.

14. A peristaltic pump as defined in claim 13 wherein each of said clamping arms is adapted for cooperation with said second clamping bar to clamp a tube of different diameter.

15. A peristaltic pump as defined in claim 12 wherein said tube receiving recesses defined between said first and second clamping bars are disposed such that the reaches of a tube received therein are substantially tangent to said rotor at the locations at which an intermediate portion of said tube engages said rotor in looped relation thereabout.

16. A peristaltic pump as defined in claim 1 including detent means mounted on said base plate for releasably maintaining said reaction members in their said open positions relative to said rotor.

17. A peristaltic pump as defined in claim 9 including means mounted on said one of said reaction members for engagement by said locking plate means to selectively maintain said locking plate means in a pivotal position spaced from said rotor.

18. A peristaltic pump comprising a base plate defining a generally planar mounting surface, a rotor rotatably supported by said base plate for rotation about an axis substantially perpendicular to said mounting surface, said rotor including at least one compression surface movable in a plane substantially parallel to said mounting surface, a pair of reaction members pivotally supported by said base plate for movement relative to said base plate between closed positions juxtaposed to said rotor and open positions spaced from said rotor, said reaction members defining cam surface means operative when said reaction members are in their said closed positions to maintain a compressible fluid flow tube in position to be engaged by said compression surface upon rotation of said rotor so as to effect a peristaltic pumping action on said tube, said reaction members when in their said open positions facilitating loading and removal of said tube relative to said rotor, tube clamping means separable from said reaction members and including a first clamping bar mounted on said base plate and a second clamping bar carried by said base plate for cooperation with said first clamping bar, said first and second clamping bars being adapted for cooperative relation with different diameter fluid flow tubes to releasably maintain a selected tube in operative relation about said rotor when said reaction members are in their said open positions, and means operatively associated with said reaction members for releasably retaining said reaction members in their said closed positions.

* * * * *

UNITED STATES PATENT AND TRADEMARK OFFICE

CERTIFICATE OF CORRECTION

PATENT NO. : 4,179,249

DATED : December 18, 1979

INVENTOR(S) : Emil J. Guttmann

It is certified that error appears in the above-identified patent and that said Letters Patent are hereby corrected as shown below:

Column 6, line 41, "10" should be --110--.

Column 7, line 46 after "between" insert --said--.

Signed and Sealed this

*Twenty-third* Day of *September 1980*

[SEAL]

*Attest:*

SIDNEY A. DIAMOND

*Attesting Officer*

*Commissioner of Patents and Trademarks*